US010144215B2

(12) United States Patent
Mihailovic et al.

(10) Patent No.: US 10,144,215 B2
(45) Date of Patent: Dec. 4, 2018

(54) METHOD FOR DETECTING AN OPERATING STATUS OF AN INKJET NOZZLE

(71) Applicant: OCE-TECHNOLOGIES B.V., Venlo (NL)

(72) Inventors: Marko Mihailovic, Venlo (NL); Tjerk E. C. Hummel, Venlo (NL); Johannes M. M. Simons, Venlo (NL); Hylke Veenstra, Venlo (NL); Cornelis W. M. Venner, Venlo (NL); Amol A. Khalate, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/643,212

(22) Filed: Jul. 6, 2017

(65) Prior Publication Data

US 2017/0305146 A1 Oct. 26, 2017

Related U.S. Application Data

(63) Continuation of application No. PCT/EP2016/050414, filed on Jan. 12, 2016.

(30) Foreign Application Priority Data

Jan. 13, 2015 (EP) ..... 15150930

(51) Int. Cl.
*B41J 2/045* (2006.01)
*B41J 2/14* (2006.01)

(52) U.S. Cl.
CPC ..... *B41J 2/0451* (2013.01); *B41J 2/04581* (2013.01); *B41J 2/04586* (2013.01); *B41J 2/04596* (2013.01); *B41J 2002/14354* (2013.01)

(58) Field of Classification Search
CPC .. B41J 2/04581; B41J 2/0451; B41J 2/16579; B41J 2/04588
See application file for complete search history.

(56) References Cited

U.S. PATENT DOCUMENTS 5,500,657 A * 3/1996 Yauchi ..... B41J 2/0451 347/9
6,375,299 B1 * 4/2002 Foster ..... B41J 2/0451 347/19

(Continued)

FOREIGN PATENT DOCUMENTS

EP 1 584 474 A1 10/2005
WO WO 2010/023135 A1 3/2010

OTHER PUBLICATIONS

European Search Report for EP 15 15 0930 completed on Jul. 1, 2015.

(Continued)

*Primary Examiner* — John P Zimmermann
(74) *Attorney, Agent, or Firm* — Birch, Stewart, Kolasch & Birch, LLP

(57) ABSTRACT

An inkjet print head includes an ejection unit having a liquid chamber for holding an amount of liquid, a electromechanical transducer operatively coupled to the liquid chamber for generating a pressure wave in the amount of liquid and a nozzle in fluid communication with the liquid chamber for enabling a droplet of the amount of liquid to be ejected through the nozzle. A method for detecting an operating state of the ejection unit includes the consecutive steps of actuating the electromechanical transducer to generate a pressure wave in the liquid; actuating the electromechanical transducer to suppress a residual pressure wave in the liquid; sensing an amplitude of the residual pressure wave in the liquid; and based on the result of the sensing step determining that the ejection unit is (i) in an operative state if the (Continued)

amplitude of the residual pressure wave is below a threshold or (ii) in a malfunctioning state if the amplitude of the residual pressure wave is above the threshold.

5 Claims, 5 Drawing Sheets

(56) References Cited

U.S. PATENT DOCUMENTS 6,481,833 B1 * 11/2002 Fujii ..... B41J 2/04525 347/68
7,210,771 B2 * 5/2007 Neese ..... B41J 2/17513 347/85
7,387,356 B2 * 6/2008 Shinkawa ..... B41J 2/16579 347/19
9,457,560 B2 * 10/2016 Ready ..... B41J 2/04506
2002/0089562 A1 * 7/2002 Simons ..... B41J 2/0451 347/19
2005/0116977 A1 6/2005 Shinkawa et al.
2005/0212845 A1 9/2005 Shinkawa
2006/0055745 A1 * 3/2006 Yagi ..... B41J 2/14233 347/71
2013/0293610 A1 11/2013 Suzuki et al.
2014/0285554 A1 9/2014 Yanaka et al.
2015/0054879 A1 * 2/2015 Ready ..... B41J 29/393 347/19

OTHER PUBLICATIONS

International Search Report for PCT/EP2016/050414 dated Mar. 22, 2016.
Written Opinion of the International Searching Authority for PCT/EP2016/050414 dated Mar. 22, 2016.

* cited by examiner

METHOD FOR DETECTING AN OPERATING STATUS OF AN INKJET NOZZLE

CROSS REFERENCE TO RELATED APPLICATIONS

This application is a Continuation of PCT International Application No. PCT/EP2016/050414, filed on Jan. 12, 2016, which claims priority under 35 U.S.C. 119(a) to Patent Application No. 15150930.4, filed in Europe on Jan. 13, 2015, all of which are hereby expressly incorporated by reference into the present application.

FIELD OF THE INVENTION

The present invention generally pertains to a method for determining an operating state of a piezo-actuated nozzle of an inkjet print head.

BACKGROUND ART

A known inkjet print head comprises a number of ejection units, wherein each ejection unit comprises a liquid chamber for holding an amount of liquid. Commonly, the liquid is an ink, such as a solvent-based or water-based ink, a hot-melt ink at an elevated temperature or a UV-curable ink, but the liquid may be any other kind of liquid. Other examples include liquids that need to be accurately dosed.

Each ejection unit of the known inkjet print head further comprises an electromechanical transducer operatively coupled to the liquid chamber for generating a pressure wave in the liquid held in the liquid chamber. A well-known electromechanical transducer is a piezo-actuator, comprising two electrode and a layer of piezo-electric material arranged therebetween. When an electric field is applied by application of a voltage over the electrodes, the piezo-material mechanically deforms and the deformation of the piezo-actuator generates the pressure wave in the liquid. Other kinds of electromechanical transducers are also known for use in an inkjet print head, such as an electrostatic actuator. Hereinafter, the electromechanical transducer may also be referred to as the actuator.

Each ejection unit further comprises a nozzle in fluid communication with the liquid chamber. If a suitable pressure wave is generated in the liquid in the liquid chamber, a droplet of the liquid is expelled through the nozzle. If the liquid is an ink, the droplet may impinge on a recording medium and form an image dot on the recording medium. A pattern of such image dots may form an image on the recording medium as well-known in the art.

A known disadvantage of the above-described inkjet print head is the susceptibility to malfunctioning of the ejection units. In particular, it is known that an air bubble may be entrained in the nozzle or in the liquid chamber. Such an air bubble changes the acoustics of the ejection unit and as a consequence a droplet may not be formed when the pressure wave is generated. Another known cause for malfunctioning is dirt particles (partly) blocking the nozzle. The presence of dirt does not only block the liquid flow, but also changes the acoustics.

It is well-known in the art to sense a residual pressure wave in the liquid. After the generation of a pressure wave, the acoustics of the ejection unit result in a residual pressure wave that damps over time. Sensing and analyzing this residual pressure wave provides detailed information on the acoustics of the ejection unit. A comparison between the acoustics derived from the residual pressure wave and the acoustics of an ejection unit in an operative state enable to derive the operating state of the ejection unit. Moreover, it is known to determine a cause for a malfunctioning state from the residual pressure wave, if a malfunction state is derived.

A disadvantage of the known method for detecting an operating state is the time needed for sensing the residual pressure wave and the time needed for analysis of the residual pressure wave. Due to this relatively long period needed for sensing and analyzing, it is not possible to perform the analysis for each ejection unit after each droplet ejection.

Moreover, even if there would be sufficient time between consecutive droplet ejections, the computational power needed to analyze each ejection unit after each droplet ejection would be so high, that this would not be commercially feasible.

SUMMARY OF THE INVENTION

In an aspect of the present invention, a method according to claim 1 is provided. In the method, after generating a pressure wave in the liquid, the electromechanical transducer is actuated to suppress a residual pressure wave in the liquid. Such a suppression of a residual pressure wave is commonly also referred to as quenching a residual pressure wave. After quenching, an amplitude of the residual pressure wave in the liquid is sensed. Based on the sensed amplitude, it is determining that the ejection unit is either (i) in an operative state if the amplitude of the residual pressure wave is below a threshold or (ii) in a malfunctioning state if the amplitude of the residual pressure wave is above the threshold.

Quenching is known from the prior art for removing any residual pressure wave in an ejection unit in order to prepare the ejection unit for a next droplet ejection. A residual pressure wave affects a subsequently generated pressure wave and hence affects a subsequent droplet in size, speed, and/or any other property. Quenching is known to ensure droplet formation without influence from a previous droplet formation.

The present invention is based on the consideration that a quench pulse, i.e. an actuation pulse applied to the electromechanical transducer for quenching the residual pressure wave, is highly adapted to the residual pressure wave that normally remains after actuation in a well-functioning (operative) liquid chamber. The acoustics of the liquid chamber are known and based on such known acoustics the quench pulse has been designed. Such a quench pulse is usually tuned with respect to timing and amplitude and often also with respect to a number of other parameters. If tuned correctly, only then a residual pressure wave with a very low amplitude remains. So, in general, any residual pressure wave remaining after the quench pulse should have a very low amplitude, as the quench pulse has been designed to do so.

If the acoustics of the liquid chamber change due to the presence of dirt particles or a gas (usually air) bubble or any other cause, the quench pulse will not be able to lower the amplitude of the residual pressure wave sufficiently. Under certain circumstances, the quench pulse may even increase the amplitude of the residual pressure wave. Sensing an amplitude and merely evaluating the value of the amplitude by comparison with a (low) threshold takes a relatively short period of time and requires relatively little computational power. Thus, the method according to the present invention enables to verify the operating state of an ejection unit even during a print job, in particular between two droplets ejected during the print job.

In an embodiment, the electromechanical transducer is a piezo-actuator. A piezo-actuator is a well-known suitable electromechanical transducer for use in inkjet print heads and has the additional advantage that the piezo-electrical property is also suitable for use as a sensor. So, in a practical embodiment, the piezo-electrical actuator is used as a pressure generator and as a pressure sensor. Application of an electrical field over the piezo-electrical material deforms the piezo-material and the deformation changes a volume of the liquid chamber, resulting in a pressure change in the liquid in the liquid chamber. On the other hand, when no electrical field is applied, the piezo-electrical material may deform due to a pressure change in the liquid. Upon deformation, the piezo-electrical material generates an electrical field, which may be sensed.

In an embodiment, the step of generating a pressure wave in the liquid includes ejecting a droplet through the nozzle. This means that the generated pressure wave is configured to expel a droplet. The configuration of a suitable actuation pulse for actuating the electromechanical transducer for generating such a pressure wave is well-known in the art and is therefore not further elucidated here. It is noted that in another embodiment, the pressure wave may be such that a suitable residual pressure wave is generated, while no droplet is expelled (i.e. a non-ejecting pressure wave). Then, using a corresponding quench pulse, such residual pressure wave may be quenched and the method according to the present invention may be carried out without expelling a droplet. Such embodiment enables to easily and quickly detect the operating state of an ejection unit during a print job, even when the ejection unit is not needed for printing for a longer period of time, for example.

In an embodiment, the step of sensing an amplitude of the residual pressure wave in the liquid comprises sensing the residual pressure wave for a predetermined period of time and deriving the amplitude from the sensed pressure wave. For a more reliable detection of a maximum amplitude, it may be advantageous to sense the residual pressure wave for a predetermined period of time and then deriving the amplitude from the sensed residual pressure wave. Of course, the longer the period of time, the more reliable the result will be. However, in view of the desired short period of time, a trade-off may be made, taking into account a (possible) frequency of a residual pressure wave, timing of a next pressure wave generation, and other parameters.

In an embodiment, the step of determining includes calculating a cumulative energy metric from the amplitude. The cumulative energy metric provides a measure for the energy present in the residual pressure wave. The cumulative energy metric corresponds to the sum of the squared amplitudes. It has appeared that this cumulative energy metric is easily calculated with minimum computational power, while at the same time being very suitable to distinguish between operative ejection units and malfunctioning ejection units which of course corresponds to the inventive concept of the present invention as it is the intention of the quench pulse to remove any wave energy. So, it may be expected that the cumulative energy metric is low for an operative ejection unit and higher for a malfunctioning ejection unit.

In an embodiment, if it is determined that the ejection unit is in a malfunctioning state, the method further comprises the consecutive steps of actuating the electromechanical transducer to generate a non-ejecting pressure wave in the liquid, thereby not ejecting a droplet; sensing the residual pressure wave; and analyzing the sensed residual pressure wave in order to determine a cause for the malfunctioning state. Based on the outcome of the steps a.-d. of the method according to the present invention and in particular when the residual pressure wave has been sensed for a predetermined period of time, it may be possible to determine a cause of malfunctioning from the sensed pressure wave after quenching. However, without first performing a quench, such determination of the cause may be more reliable and it may be possible to distinguish more different kinds of causes. Therefore, in this embodiment, the steps e.-g. may be carried out subsequently for detecting a residual pressure wave over a period of time without first performing a quenching operation.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
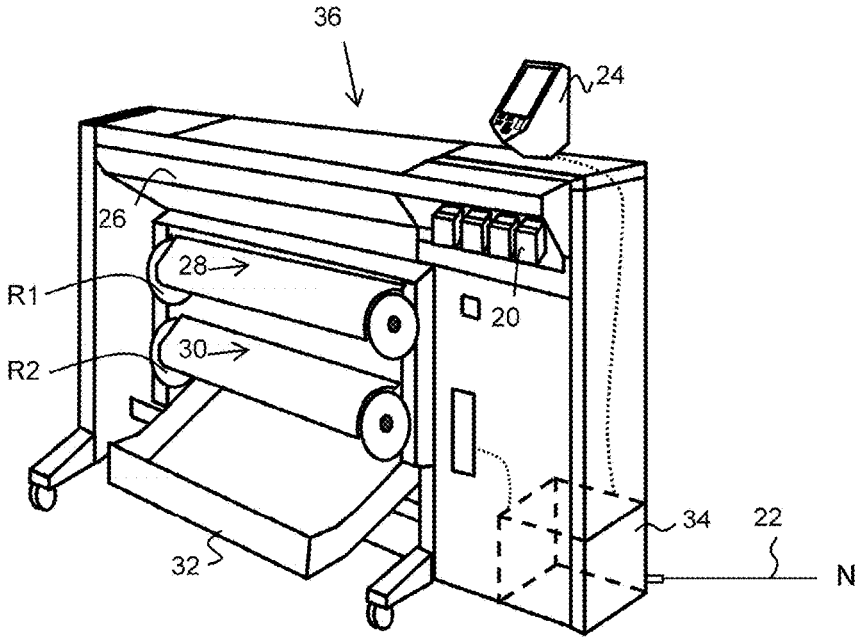
FIG. 1A is a perspective view of an exemplary image forming apparatus suitable for use with the present invention.

The present invention will now be described with reference to the accompanying drawings, wherein the same reference numerals have been used to identify the same or similar elements throughout the several views.

Figure 1B:
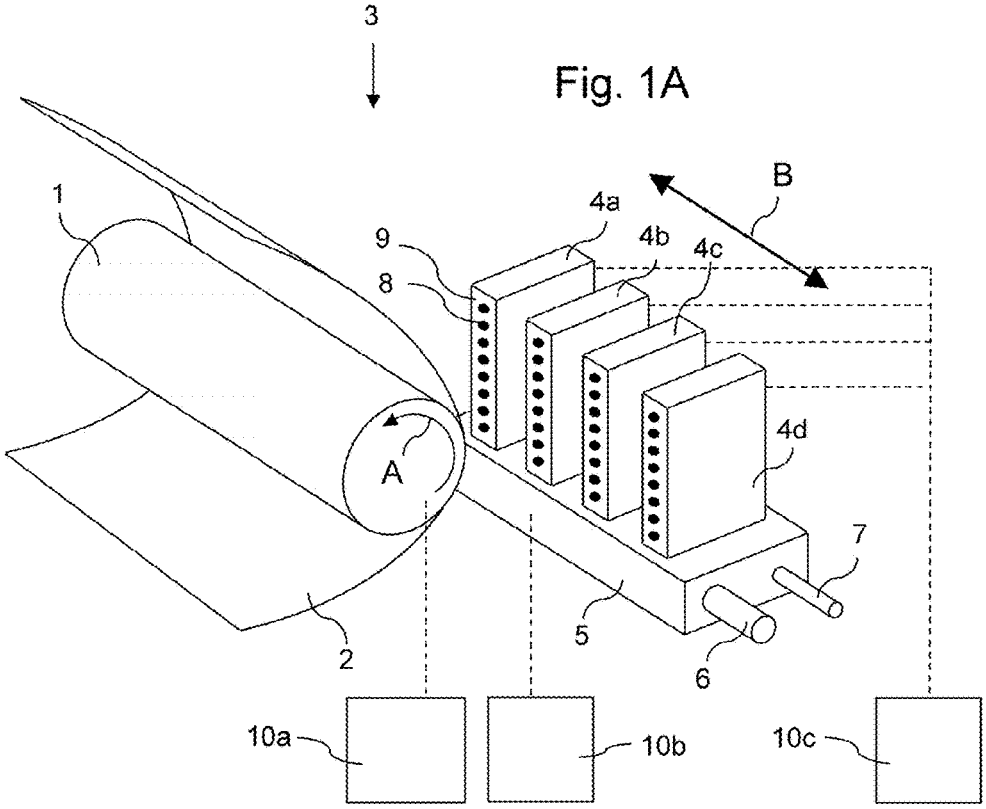
FIG. 1B is a schematic representation illustrating a scanning inkjet process.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

For use with the present invention, the print heads 4*a*-4*d* have a number of ejection units, each ejection unit corresponding to one of the orifices 8. An ejection unit comprises a liquid chamber in which a pressure wave may be generated, e.g. by suitably driving a piezo-electric element (i.e. an electromechanical transducer) associated with the ejection unit. The pressure wave may be such that a droplet of marking material (liquid) is expelled through the corresponding orifice or the pressure wave may be such that no droplet is expelled. The latter is commonly known for vibrating a meniscus of the marking material, for example. Likewise, a non-expelling pressure wave is known for use with an acoustic sensing method for detecting an operating state of the ejection unit. For example, if an air bubble is entrained in the liquid chamber of the ejection unit, the acoustics in the liquid chamber are different compared to the situation where no air bubble is present. As a consequence, a generated pressure wave will be different, too. Detecting and analyzing the pressure wave, which is referred to herein as the residual pressure wave, allows determining an operating state of the ejection unit. This method is known in the prior art and to the skilled person. Therefore, this method is not further elucidated herein.

Figure 2A:
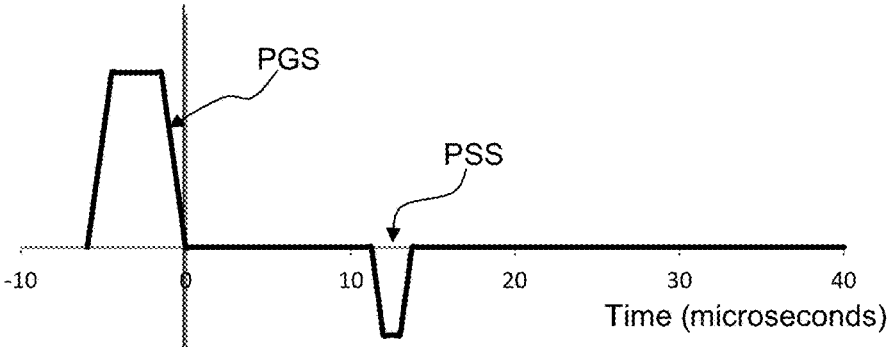
FIG. 2A is a graph schematically illustrating an exemplary actuation pulse for use in the present invention.

FIG. 2A illustrates schematically an embodiment of a drive pulse for driving an electromechanical transducer, such as a piezo-electric actuator. The horizontal axis represents time (in microseconds), while the vertical axis represents amplitude of a voltage (in arbitrary units) to be applied over electrodes of the piezo-electric actuator.

The drive pulse comprises a pressure wave generating section PGS and a pressure wave suppressing section PSS. In this exemplary embodiment, a pressure wave suppressing section PSS having a polarity opposite to the polarity of the pressure generating section PGS is shown and used. It is noted that depending on requirements and subject to other parameters like timing, a pressure suppressing section PSS having a same polarity as the pressure wave generating section PGS may be used, as is known in the art.

In the illustrated embodiment, it is assumed that the pressure wave generating section PGS results in a droplet of liquid being expelled. The pressure wave generating section PGS ends at the origin of the horizontal axis (Time=0). Starting from Time=0, a residual pressure wave remains in the liquid chamber. At about Time=11 microseconds, the pressure wave suppressing section PSS starts and it ends at about 13 microseconds after the end of the pressure wave generating section PGS. Thus, taking into account the time period of the pressure wave generating section PGS, the total duration of the drive pulse is about 20 microseconds. As the residual pressure wave is damped by the pressure wave suppressing section PSS, a next drive pulse may be started directly after the end of the pressure wave suppressing section PSS, thereby allowing a droplet frequency of about 50 kHz.

Figure 2B:
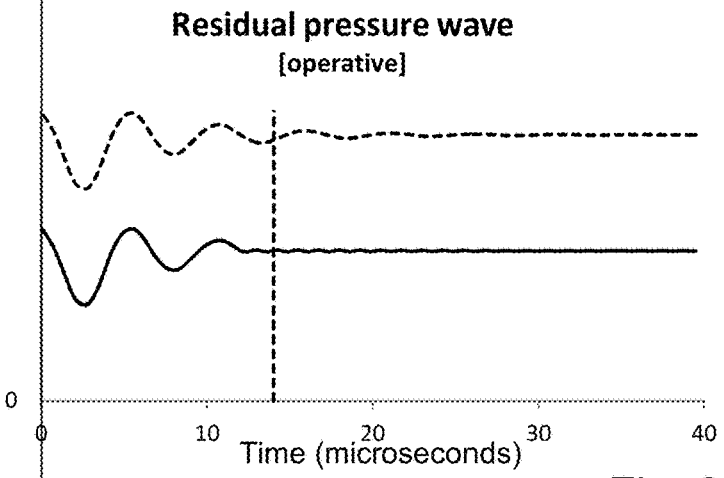
FIG. 2B is a graph schematically illustrating a residual pressure wave corresponding to an operative ejection unit.
Figure 2C:
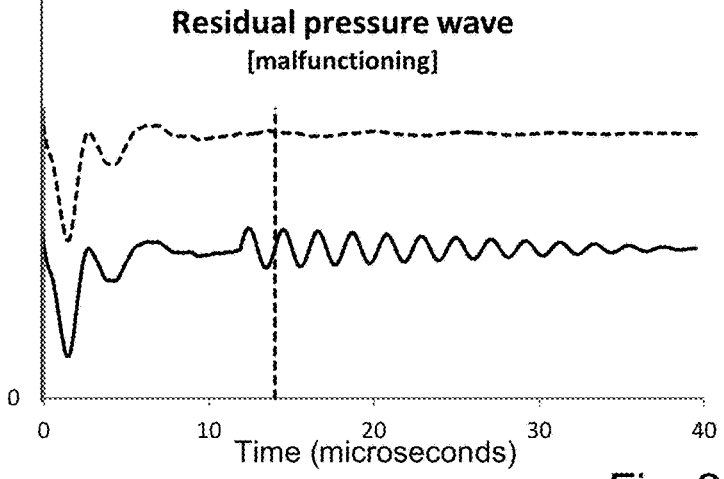
FIG. 2C is a graph schematically illustrating a residual pressure wave corresponding to a malfunctioning ejection unit.

FIGS. 2B and 2C illustrate exemplary residual pressure waves. The horizontal axis represents time in microseconds and the origin of the horizontal axis is aligned with the origin of the horizontal axis of FIG. 2A. The vertical axis of the diagrams of FIGS. 2B and 2C represents amplitude of a residual pressure wave residing in the liquid in the liquid chamber after ending of the pressure wave generating section PGS (FIG. 2A). FIG. 2B illustrates an example of a residual pressure wave of an operative (well-functioning) ejection unit and FIG. 2C illustrates an example of a residual pressure wave of a malfunctioning ejection unit.

In both diagrams (FIG. 2B and FIG. 2C), the dashed graph relates to residual pressure wave without application of a pressure wave suppressing section PSS (FIG. 2A) and the solid graph relates to a residual pressure wave with application of a pressure wave suppressing section PSS. Further, the dashed graphs are experimentally obtained data, while the effect of the pressure wave suppressing section PSS is provided artificially. In practice, the residual pressure wave after suppression (solid graph) may appear completely different. The artificial pressure wave as illustrated however is merely used to elucidate the present invention. FIGS. 4A-4C and 5A-5C illustrate experimentally obtained data, which are described and discussed hereinafter. Further, the vertical dashed line in FIGS. 2B and 2C represents the end of the pressure wave suppressing section PSS.

Now turning to FIG. 2B in particular, the dashed graph shows a residual pressure wave having substantial amplitude, which damps over time. At about 13 microseconds, there is still substantial amplitude such that starting a next droplet ejection would result in a disturbed droplet ejection, possibly resulting in an enlarged droplet, an increased droplet speed, air bubble entrainment, or the like. So, without pressure wave suppressing section PSS, a next drive pulse for expelling a droplet could only be started after about 23 microseconds as the amplitude is sufficiently low thereafter.

In the solid graph, however, the amplitude is quenched at about 11-13 microseconds by the pressure wave suppressing section PSS of the drive pulse (FIG. 2A). A residual pressure wave having minor amplitude may remain (the illustrated residual pressure wave having an increased frequency). Tuning the pressure wave suppressing section PSS correctly, the minor amplitude may be such that it does not disturb a next droplet ejection.

Further and in accordance with the present invention, detection of the amplitude and comparing the amplitude with a predetermined threshold allows to easily detect whether the quenching was successful. The threshold may be determined on the basis of a maximum value allowing a next droplet to be ejected or the threshold may be based on a value of the amplitude that usually occurs after quenching. The amplitude used in the comparison may be a maximum amplitude detected over a period of time or it may be an average value of the amplitude. In other embodiments, a value at one or more moments in time may be selected for comparison. Other aspects or properties of the amplitude may be used instead or additionally. Selecting such a suitable property or combination of properties for distinguishing between a properly quenched residual pressure wave (corresponding to an operative ejection unit) and an insufficiently quenched residual pressure wave (malfunctioning ejection unit) is deemed to be within the ambit of the person skilled in the art and is not further elucidated herein.

In FIG. 2C, the dashed graph represents a residual pressure wave derived from a malfunctioning ejection unit. The illustrated residual pressure wave has been generated by a cross-talk effect from an adjacent ejection unit. The properties and shape of a residual pressure wave are strongly dependent on the cause of the malfunctioning and may therefore appear totally different in practice. Further, as mentioned above, the effect of the pressure wave suppressing section PSS is schematically shown and artificial. In practice a completely different shape or property of the residual pressure wave may occur. Still, for illustrative purposes, the residual pressure wave as shown suffices.

From the shown dashed graph as compared to the dashed graph of FIG. 2B, it is apparent that the acoustics in the liquid chamber are completely different compared to the acoustics in an operative status. Different frequencies and different amplitudes are apparent. Moreover, at about 13 microseconds, the residual pressure wave has damped significantly and only a minor amplitude remains. As a consequence, the pressure wave suppressing section PSS (FIG. 2A) does not suppress a pressure wave, but actually generates a pressure wave having significant amplitude. This amplitude is easily detected by comparison to the very small amplitude of the residual pressure wave in the operative ejection unit after quenching. In general, any change of amplitude, frequency, phase, or any other property of the residual pressure wave due to changed acoustics will result in an unsuccessful quenching. Successful quenching results in a negligible amplitude. So, unsuccessful quenching inevitably leads to a higher amplitude. A higher amplitude is easily detected in a relatively short period of time in accordance with the present invention.

Figure 3A:
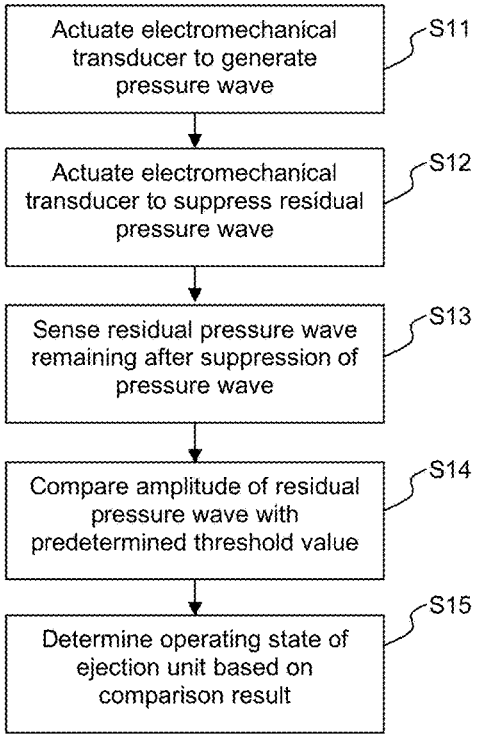
FIG. 3A is a diagram illustrating an embodiment of the method according to the present invention.

FIG. 3A shows an embodiment of the method according to the present invention in a number of steps. The method commences with a first step S11 of generating a pressure wave in the liquid chamber of the ejection unit by actuation of the corresponding electromechanical transducer. The generated pressure wave may be intended to expel a droplet, i.e. an expelling pressure wave, or may be intended to merely generate a pressure wave without expelling a droplet, i.e. a non-expelling pressure wave. After pressure generation, usually a certain period of time is past before continuing with the second step S12, but the method according to the present invention is not limited to such embodiment.

In the second step S12, another actuation of the electromechanical transducer is effected, but this time with the intent to suppress a residual pressure wave. Such a residual pressure wave inevitably remains in the liquid in the liquid chamber after generating a pressure wave therein. The residual pressure wave normally damps over time. In the second step S12, the residual pressure wave is actively damped.

As the actuation pulse of the second step S12 is tuned to the pressure generation of the first step S11, the residual pressure wave may be presumed to be only fully damped if the pressure generating actuation of the first step S11 was successful and no acoustics disturbing aspects are present in the ejection unit. Using this insight, in the third step S13, the residual pressure wave after quenching is sensed and in the fourth step S14 compared to a predetermined threshold. Suitable predetermining the threshold allows detecting whether the residual pressure wave has been successfully quenched, or not. In the fifth step, it is decided that the ejection unit is in an operative state, if the quenching was successful (amplitude lower than threshold) and it is decided that the ejection unit is in a malfunctioning state if the quenching was not successful (amplitude larger than threshold).

Figure 3B:
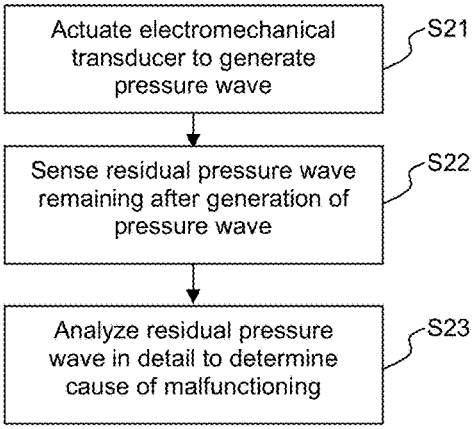
FIG. 3B is a diagram illustrating optional method steps for use in combination with the method according to FIG. 3A.

If it is decided in the fifth step that the ejection unit is in a malfunctioning state, it may be desirable to determine the cause of the malfunctioning. However, due to the pressure wave suppressing section PSS (FIG. 2A) of the drive pulse and only sensing the residual pressure wave after application thereof, it is unlikely that the cause may be derived from the sensed residual pressure wave. Therefore, it may be desired to perform a detailed analysis on a full residual pressure wave without application of a pressure wave suppressing section PSS of the drive pulse. FIG. 3B illustrates the steps that may be performed after the decision of a malfunctioning ejection unit.

So, in a sixth step S21, another pressure wave is generated by actuating the electromechanical transducer. Like in the first step S11, it may be an expelling pressure wave or a non-expelling pressure wave. However, considering that it is decided that the ejection unit is malfunctioning and considering that the method may be performed during a print job, it may be desirable to use a non-expelling pressure wave to prevent deterioration of image quality of the print job due to undesired droplets. Then in a seventh step S22, the residual pressure wave is sensed. For best results, it is desirable to start sensing as soon as the pressure wave generation section PSG of the drive pulse has ended as the amplitude of the residual pressure wave is largest at that moment. However, in an embodiment, a predetermined period of time may be waited before commencing with sensing. In an eighth step and in accordance with the prior art, the residual pressure wave may be analyzed in detail to identify the cause of malfunctioning. Multiple signal analysis methods are known from the prior art and such analysis is consequently deemed to lie within the ambit of the skilled person. Such analysis is therefore not further elucidated herein.

Figure 4A:
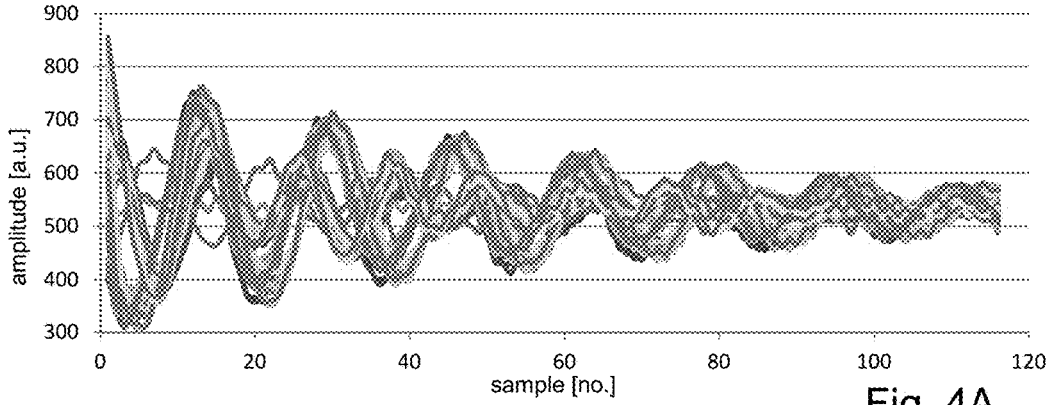
FIG. 4A-4C show diagrams illustrating the residual pressure waves of multiple actual ejection units without application of a quench pulse and their corresponding cumulative energy metric.

FIG. 4A illustrates residual pressure waves obtained from an inkjet print head, wherein a number of ejection units are in an operative state and a number of ejection units are in a malfunctioning state. In particular, the malfunctioning ejection units have been driven to entrain an air bubble in order to illustrate the present invention. The residual pressure waves have been obtained without application of a quench pulse. The residual pressure waves correspond to the residual pressure waves of the Background Art (as described hereinabove).

As is apparent from FIG. 4A the residual pressure waves have a similar shape (in particular amplitude and frequency), irrespective of whether the corresponding ejection units are operative or malfunctioning. Still, there is a difference, which is illustrated in FIG. 4B.

Figure 4B:
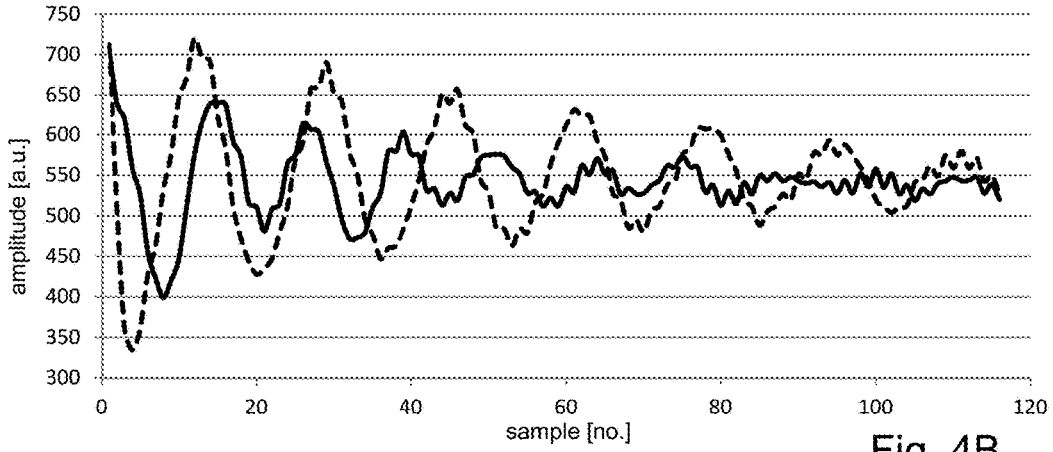

In FIG. 4B, one of the residual pressure waves corresponding to an operative ejection unit (dashed graph) and one of the residual waves corresponding to a malfunctioning ejection unit (solid graph) are taken from the number of graphs of FIG. 4A. Having both residual pressure waves available and using complex signal analysis techniques, it is possible to determine whether the residual pressure waves are from an operative or a malfunctioning ejection unit. As above mentioned, this requires a relatively large computational power and a long acquisition time as about all (about 120) samples, corresponding to almost 60 microseconds acquisition time) are needed to have a reliable determination.

Figure 4C:
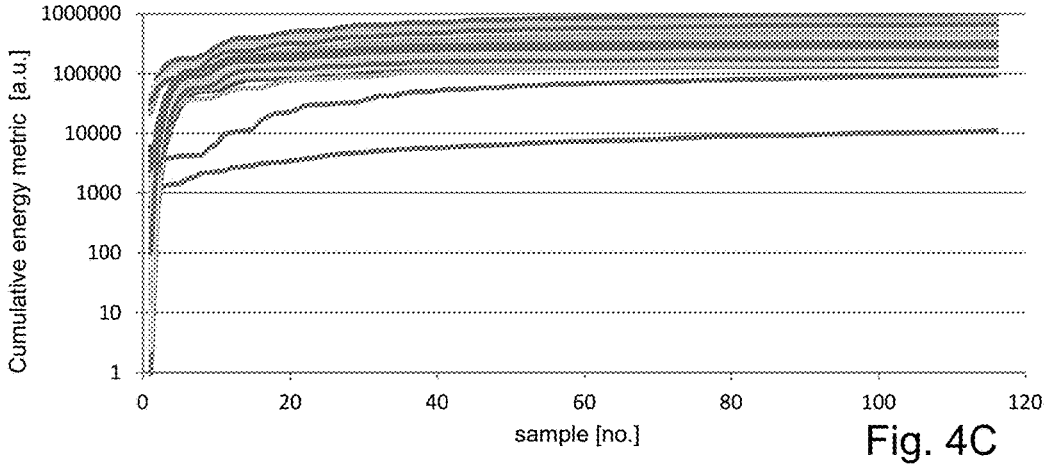

For purposes of comparison with the present invention, FIG. 4C illustrates the cumulative energy metrics for the residual pressure waves shown in FIG. 4A. In particular, the residual pressure waves as shown in FIGS. 4A and 4B consist of about 120 samples. The cumulative energy metric for a given sample is a sum of squared amplitude of the given sample and all previous samples. The cumulative energy metric may be calculated as:

$$CEM_N = \sum_{i=1}^{N} a_i^2$$

wherein $CEM_N$ is the cumulative energy metric for the $N^{th}$ sample and $a_i$ is the value (amplitude) of the $i^{th}$ sample. As apparent from FIG. 4C, it is not possible to distinguish between the operative and the malfunctioning ejection units based on the cumulative energy metric.

Figure 5A:
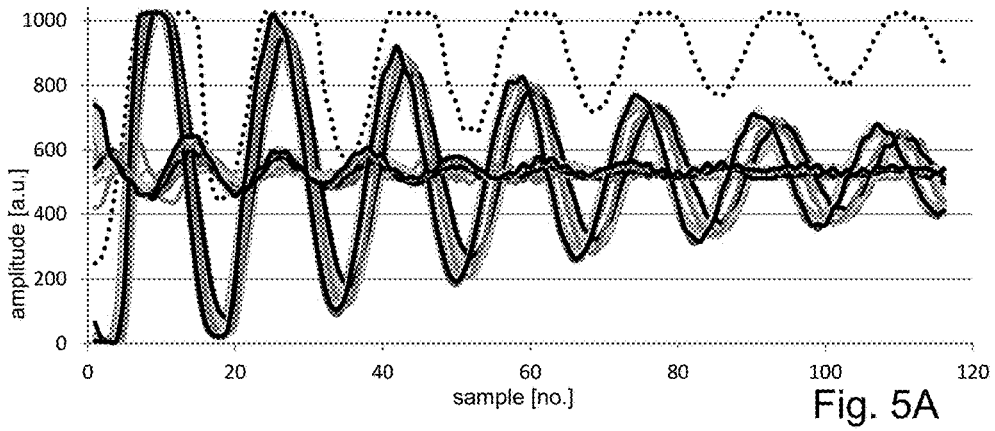
FIG. 5A-5C show diagrams illustrating the residual pressure waves of multiple actual ejection units with application of a quench pulse and their corresponding cumulative energy metric.

FIG. 5A illustrates residual pressure waves obtained from an inkjet print head, wherein a number of ejection units are in an operative state and a number of ejection units are in a malfunctioning state. In particular, the malfunctioning ejection units have been driven to entrain an air bubble in order to illustrate the present invention. The residual pressure waves have been obtained with application of a quench pulse. The residual pressure waves thus correspond to the residual pressure waves as employed in the present invention.

Figure 5B:
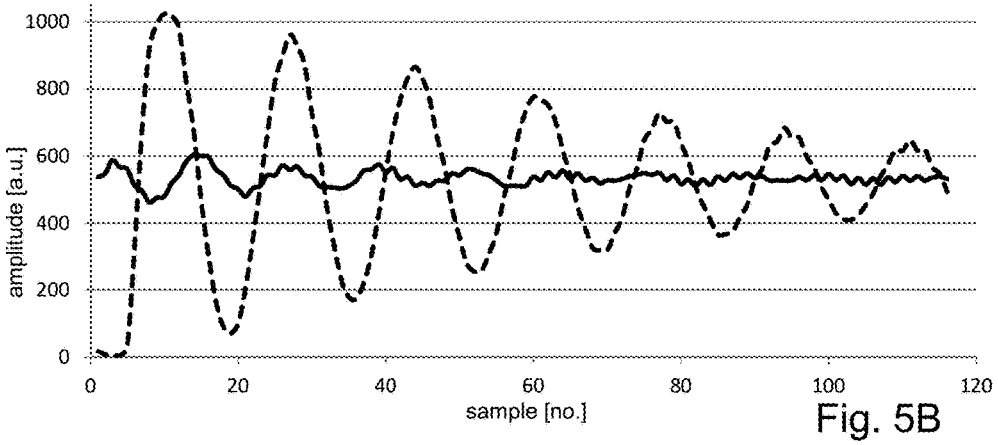

Similar to FIG. 4B, FIG. 5B shows two exemplary residual pressure waves of the number of residual pressure waves of FIG. 5A. As apparent from FIGS. 5A and 5B, there are a number of residual pressure waves having a low amplitude (solid graph in FIG. 5B and having a mean value of about 550 a.u. (arbitrary units)) and there are a number of residual pressure waves having a significantly larger amplitude (dashed graph in FIG. 5B). The significant difference in amplitude allows a significantly simpler algorithm to distinguish between an operative (solid graph) and a malfunctioning (dashed graph) ejection unit. This becomes even more apparent when considering FIG. 5C.

Figure 5C:
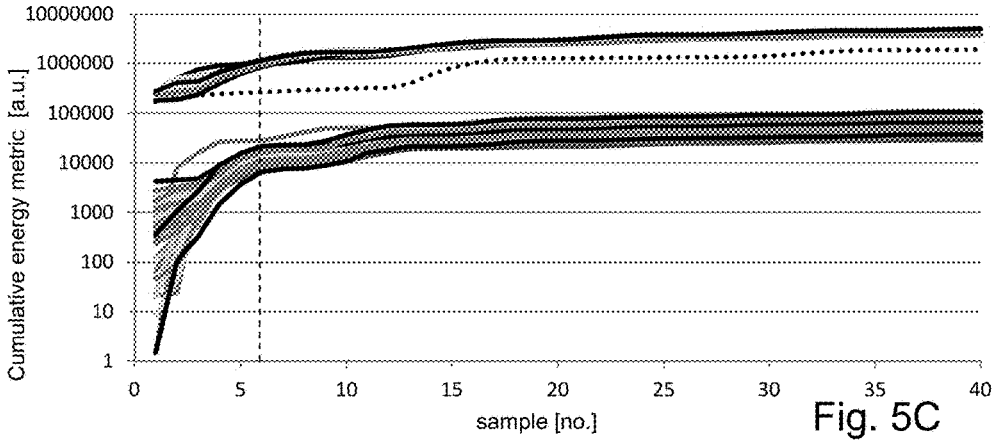

In FIG. 5C, the cumulative energy metrics of the residual pressure waves of FIG. 5A are shown. It is apparent that there are two separate sets. A set having a value starting from less than 1 (please note the logarithmic scale on the vertical axis representing the CEM in a.u.) to about 100,000. A second set has a value starting from about 200,000 to about 10,000,000. Basically, it would be possible to distinguish between operative and malfunctioning ejection units based on the value of the cumulative energy metric of the first sample: operative ejection units have a value less than 100,000 and malfunctioning ejection units have a value of more than 100,000. However, depending on phase of the residual pressure wave, it would be possible for a malfunctioning ejection unit to have a cumulative energy metric for the first sample below 100,000. In the present example, that is best illustrated by referring to the values of the first sample of the operative ejection units. The values of the first cumulative energy metrics lie in a range from about 1 to about 10,000. However, after a small number of samples, e.g. 6 samples corresponding to about 2.5 microseconds, these values have converged. The same applies to the set of cumulative energy metrics corresponding to the malfunctioning ejection units. In any case, it is apparent that the cumulative energy metrics of the operative and malfunctioning ejection units are easily separable by a simple threshold operation and already very shortly after starting the acquisition of the amplitude of the residual pressure wave.

Returning to FIG. 5A, there is one significantly deviating residual pressure wave: the one graph having samples 60-120 with values above 800 a.u. (dotted graph). The corresponding cumulative energy metric graph is also visible in FIG. 5C: it is the (dotted) graph starting with the graphs of the malfunctioning ejection units at a value of about 200,000, but then gradually becoming lower than the other graphs, resulting in having a value of about 300,000 at sample 10, while the cumulative energy metric for the malfunctioning ejection units is more than 1,000,000 at sample 10. The cause for this one deviating residual pressure wave is known.

In the corresponding ejection unit, an air bubble is developing, meaning that a minor air bubble is entrained and the air bubble is growing. Moreover, this air bubble is not yet disturbing the droplet ejection, but it is known that if no corrective action is performed, the air will grow to a disturbing size. So, the present method is also very suitable for predicting future disruption of droplet ejection due to air bubble entrainment. Also for this reason, it may be preferred to perform the step of determining the operating state of an ejection unit after about 5-10 samples of the residual pressure wave, wherein two thresholds may be applied for distinguishing between operative, malfunctioning and near-future-malfunctioning ejection units. Knowing which ejection units will malfunction in the near future allows applying nozzle compensation schemes during printing to prevent the loss of image pixels even before it occurs due to malfunctioning ejection units.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for detecting an operating state of an ejection unit of an inkjet print head, the ejection unit comprising a liquid chamber for holding an amount of liquid, a electromechanical transducer operatively coupled to the liquid chamber for generating a pressure wave in the amount of liquid and a nozzle in fluid communication with the liquid chamber for enabling a droplet of the amount of liquid to be ejected through the nozzle, the method consecutively comprising a. actuating the electromechanical transducer to generate a pressure wave in the liquid;

b. actuating the electromechanical transducer with an actuation pulse adapted to the pressure wave generated in the liquid in an operative ejection unit to suppress a residual pressure wave in the liquid;

c. sensing an amplitude of the suppressed residual pressure wave in the liquid;

d. based on the result of step c. determining that the ejection unit is i. in an operative state if the amplitude of the suppressed residual pressure wave is below a threshold;

ii. in a malfunctioning state if the amplitude of the suppressed residual pressure wave is above the threshold.

2. The method according to claim 1, wherein the electromechanical transducer is a piezo-actuator.

3. The method according to claim 1, wherein step a. includes ejecting a droplet through the nozzle.

4. The method according to claim 1, wherein step c. comprises sensing the residual pressure wave for a predetermined period of time and deriving the amplitude from the sensed pressure wave.

5. The method according to claim 1, wherein if it is determined that the ejection unit is in a malfunctioning state, the method further comprises the consecutive steps e. actuating the electromechanical transducer to generate a non-ejecting pressure wave in the liquid, thereby not ejecting a droplet;

f. sensing the residual pressure wave; and g. analyzing the sensed residual pressure wave in order to determine a cause for the malfunctioning state.

* * * * *